US006276793B1

(12) United States Patent
Kazakos et al.

(10) Patent No.: US 6,276,793 B1
(45) Date of Patent: Aug. 21, 2001

(54) INK JET PRINTER HAVING A WEAR RESISTANT AND EFFICIENT SUBSTRATE HEATING AND SUPPORTING ASSEMBLY

(75) Inventors: Ann M. Kazakos; Michael J. Duggan, both of Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/184,673

(22) Filed: Nov. 2, 1998

(51) Int. Cl.[7] ..... B41J 2/01
(52) U.S. Cl. ..... 347/102; 347/103; 219/216
(58) Field of Search ..... 347/108, 102, 347/103; 399/333, 303, 398; 219/216; 271/900

(56) References Cited

U.S. PATENT DOCUMENTS 4,538,156 * 8/1985 Durkee et al. ..... 346/21
4,628,183 * 12/1986 Satomura ..... 219/216
4,849,774 7/1989 Endo et al. ..... 346/140
5,532,724 * 7/1996 Inagaki et al. ..... 347/213
5,771,054 * 6/1998 Dudek et al. ..... 347/102
5,805,191 * 9/1998 Jones et al. ..... 347/103
5,969,740 * 10/1999 Maeda et al. ..... 347/101
6,076,921 * 6/2000 Rezanka et al. ..... 347/102
6,091,437 * 7/2000 Yoneda et al. ..... 347/203

* cited by examiner

*Primary Examiner*—Huan Tran
*Assistant Examiner*—Manish S. Shah
(74) *Attorney, Agent, or Firm*—Tallam I. Nguti

(57) ABSTRACT

A thermal ink jet printer including a frame, a printhead mounted to the frame for printing ink images onto a heated and supported substrate, and a wear resistant and efficient substrate heating and supporting assembly mounted to the frame. The wear resistant and efficient substrate heating and supporting assembly includes metallic core having an inner surface and an outer surface, a heating device for heating the inner surface of the metallic core, and a ceramic aluminum nitride or aluminum oxide coating formed over the outer surface of the metallic core for contacting and supporting a substrate, and for durably withstanding scraping contact from a stripper member used for stripping substrates from a surface of said ceramic coating.

12 Claims, 2 Drawing Sheets

INK JET PRINTER HAVING A WEAR RESISTANT AND EFFICIENT SUBSTRATE HEATING AND SUPPORTING ASSEMBLY

BACKGROUND OF THE INVENTION

The present invention relates generally to liquid ink recording apparatus or ink jet printers, and more particularly relates to such a recording apparatus including a wear resistant and efficient sheet or substrate heating and supporting assembly.

Liquid ink printers of the type frequently referred to either as continuous stream or as drop-on-demand, such as piezoelectric, acoustic, phase change wax-based or thermal, have at least one printhead from which droplets of ink are directed towards a recording sheet. Within the printhead, the ink is contained in a plurality of channels. For a drop-on-demand printhead power pulses cause the droplets of ink to be expelled as required from orifices or nozzles at the end of the channels.

In a thermal ink-jet printer, the power pulses are usually produced by formation and growth of vapor bubbles on heating elements or resistors, each located in a respective one of the channels, which are individually addressable to heat and vaporize ink in the channels. As voltage is applied across a selected resistor, a vapor bubble grows in the associated channel and initially expels the ink therein from the channel orifice, thereby forming a droplet moving in a direction away from the channel orifice and towards the recording medium where, upon hitting the recording medium, a dot or spot of ink is deposited. Following collapse of the vapor bubble the channel is refilled by capillary action, which, in turn, draws ink from a supply container of liquid ink. Operation of a thermal ink-jet printer is described in, for example, U.S. Pat. No. 4,849,774.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a supported, stationary recording medium, such as paper or a transparency.

After the swath is printed, the paper is stepped a distance equal to the height of the printed swath or a portion thereof, so that the next printed swath is contiguous or overlapping therewith. This procedure is repeated until an entire page is printed. In contrast, the page width printer includes a stationary printhead having a length sufficient to print across the width or length of a supported sheet of recording medium at a time. The supported recording medium is continually moved past the page width printhead in a direction substantially normal to the printhead length and at a constant or varying speed during the printing process.

In either case, the substrate or sheet is supported and heated on a heating and supporting assembly that includes a platen and a heating device in order to dry the printed swath and prevent it from bleeding into an adjacent swath. Typically, the sheet supporting platen consists of a flat surface, or of a rotating hollow drum, that in either case, has a back surface, and a front surface that has an area which is large enough to support up to a legal size sheet, with border areas left over. In the case of a rotating hollow drum platen for example, heat is generated by a radiant heater or heating device mounted inside the hollow of the drum. The sheet may be attached electrostatically to the surface of the drum by first applying a layer of charges, and then attach the sheet thereto. Heat then must be delivered from the inner surface of the drum through the wall of the drum to the supported sheet.

Conventional sheet heating and supporting assemblies typically consist for example of an aluminum core and an insulating film of MYLAR or KAPTON (trademarks of Du Pont) wrapped around a drum. At areas where such film does not make intimate contact with the surface of the drum, static charges on the surface will not hold the paper to that portion of the surface, and heat conduction will be detrimentally affected, and the ink will not be dried adequately. Additionally, any stripper fingers used for stripping sheets from the surface of the plastic sheet, will tend to abrade such surface, thus causing contact failure between sheets and such surface.

SUMMARY OF THE INVENTION

In accordance with the present invention, there is provided a thermal ink jet printer including a frame, a printhead mounted to the frame for printing ink images onto a heated and supported substrate, and a wear resistant and efficient substrate heating and supporting assembly mounted to the frame. The wear resistant and efficient substrate heating and supporting assembly includes a body portion having a uniform first surface and a second and opposite surface adjacent said heating device, said uniform first surface including a ceramic coating formed thereover for contacting and supporting a substrate, and for durably withstanding scraping contact from a stripper member used for stripping substrates from a surface of said ceramic coating.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
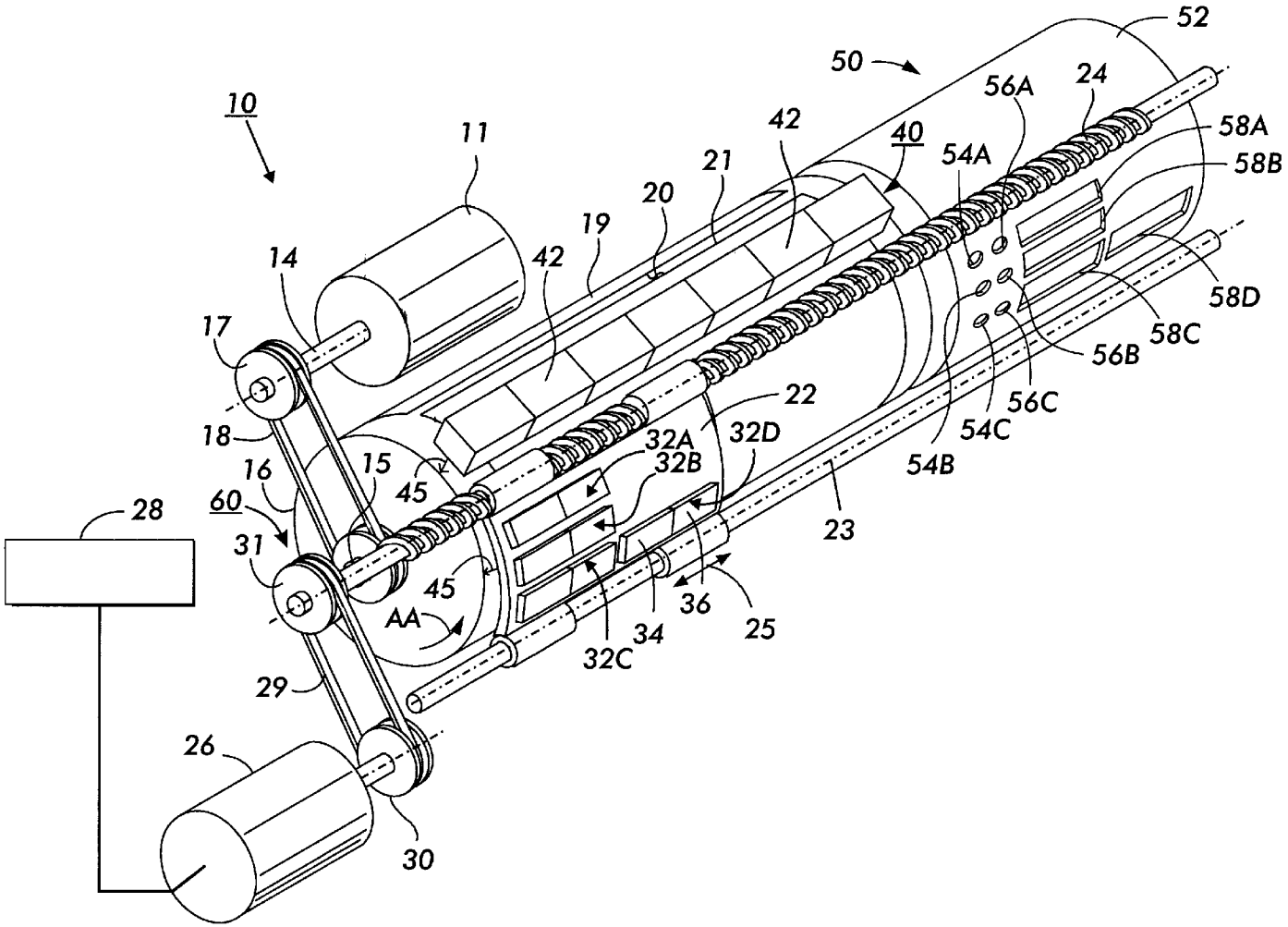
FIG. 1 illustrates a partial perspective view of an ink jet printing apparatus including and wear resistant and efficient sheet or substrate heating and supporting assembly in accordance with the present invention.

Referring now to FIG. 1, the essential components of a printing apparatus or printer, generally designated 10, are illustrated. As shown, the outside covers or case and associated supporting components of the printing apparatus 10 are omitted for clarity. The essential components of the printing apparatus 10 include a motor 11 connected to a suitable power supply (not shown) and arranged with an output shaft 14 parallel to an axis 15 of a rotatable cylindrical drum 16 of a wear resistant and efficient substrate heating and supporting assembly 60 of the present invention (to be described in detail below). A pulley 17 permits direct engagement of the output shaft 14, to a drive belt 18 for enabling the drum 16 to be continuously rotationally driven by the motor 11 in the direction of an arrow M at a predetermined rotational speed.

A recording medium such as a sheet of paper or a transparency 19 (letter size or legal size) is placed over an outer surface 20 of the drum 16, with its leading edge 21 attached to the surface 20. Typically, the sheet is attached to the drum 16 either by the application of a vacuum, using holes in the drum 16 (not shown), or by other means of holding the sheet to the drum, for example, electrostatic means. In operation, as the drum 16 with a sheet 19 attached thereto rotates, it moves the sheet 19 with it past a printhead carriage 22.

The printhead carriage 22 is supported for example by a lead screw 24 that is mounted so that its axis is parallel to the axis 15 of the drum 16. Additionally, it is supported by fixed bearings (not shown) which enable it (the carriage 22) to be capable of slidably translating axially. A carriage rail 23 provides further support for the carriage 22 as it moves in the direction of arrow 25, that is perpendicular to the moving direction of the sheet 19. A second motor 26, such as a stepper motor or other positioning mechanism, which is controlled by a controller 28, drives the lead screw 24 with a second belt 29. As shown, the belt 29 is connected to a clutch 30, and to another clutch 31 that is attached to the lead screw 24 for movement thereof.

The printer 10, for example, includes printhead partial width arrays 32 that are each filled or charged with printing ink. The printhead partial width arrays 32 comprise a first partial width array printbar 32A, a second partial width array printbar 32B, a third partial width array printbar 32C, and a fourth partial width array printbar 32D. Each printbar 32A–32D as shown includes at least a printhead 34, or as preferred here, two printheads, a first printhead 34 and a second printhead 36 that are butted together to form such printbar.

Each of the printheads 34 and 36 includes several hundred or more channels and nozzles which in operation can be fired sequentially. In operation the partial width arrays 32, when charged or filled with ink, can be moved in the direction of arrow 25 for printing on the sheet. When filled with ink as such, the first, second and third partial width array printbars 32A–32C, respectively, will each contain ink of one of the colors cyan, magenta or yellow, for color printing. The fourth partial width array printbar 32D will contain black ink when necessary, especially when needed for printing graphics.

In addition to the partial width arrays 32, the printer 10 may also include a full-width array or pagewidth printbar 40 that is also filled or charged with printing ink. The pagewidth printbar 40 is supported by an appropriate support structure (not shown) above the drum 16 for printing on the recording medium when filled or charged with printing ink. The pagewidth printbar 40 has a length sufficient to print across the entire width (or length) of the recording medium during a single pass of the recording medium beneath the printbar. The printbar 40 as shown, includes a plurality of printhead units 42 that are affixed to a supporting member (not shown) in an abutted fashion. Alternatively, individual printhead units 42 may be spaced from one another by a distance approximately equal to the length of a single printhead subunit and bonded to opposing surfaces of the supporting member.

In each case, a front or forward facing edge of each printhead unit 34, 36 and 42, contains liquid droplet ejecting orifices or nozzles which can in operation, eject ink droplets along a trajectory 45 (FIG. 1), which is substantially perpendicular to the surface of a recording medium. As is well known, each printhead contains heating elements and printed wiring boards (not shown). The printed wiring boards contain circuitry required to interface and cause the individual heating elements in the printhead units to eject liquid (e.g. ink) droplets from the nozzles. While not shown, the printed wiring boards are connected to individual contacts contained on the printhead units via a commonly known wire bonding technique. The data required to drive the individual heating elements is supplied from an external system by a standard printer interface, modified and/or buffered by a printer micro processor (not shown) within the printer.

Referring again to FIG. 1, the printer or printing apparatus 10 preferably includes a maintenance system 50 located at one end of the drum 16 for preventing the nozzles in particular from drying out during idle periods following the printhead being filled with ink as above. The maintenance system 50 includes assemblies which provide wet wiping of the nozzles of the printheads 32 and 34 as well as vacuuming of the same printheads for maintenance thereof. Wet wipers and vacuuming of nozzles typically include a fluid applicator and vacuum means that are located within a stationary drum housing 52 and extend through a plurality of apertures 54A, 54B and 54C when necessary to provide maintenance functions. When the printhead carriage moves to the maintenance position, the wet wipers apply a fluid to the ink jet nozzles such that any dried ink, viscous plugs or other debris is loosened on the front face of the ink jet printbars. Once the debris has been sufficiently loosened, a plurality of vacuum nozzles each extending through a plurality of vacuum nozzle apertures 56A-56C vacuum away any of the cleaning fluid as well as any debris loosened thereby.

Once a printing operation has been completed and any cleaning of the printbars has been completed, if necessary, the carriage 22 is moved into position above another plurality of apertures 58A–58D. A plurality of capping members disposed within the housing 50, are moved into contact with the front faces of the printbars 32 and 34 through the apertures 58A–58D to thereby cap nozzles of the printheads in order to substantially prevent any ink which has been collected in the nozzles of the printheads from drying out.

Figure 2:
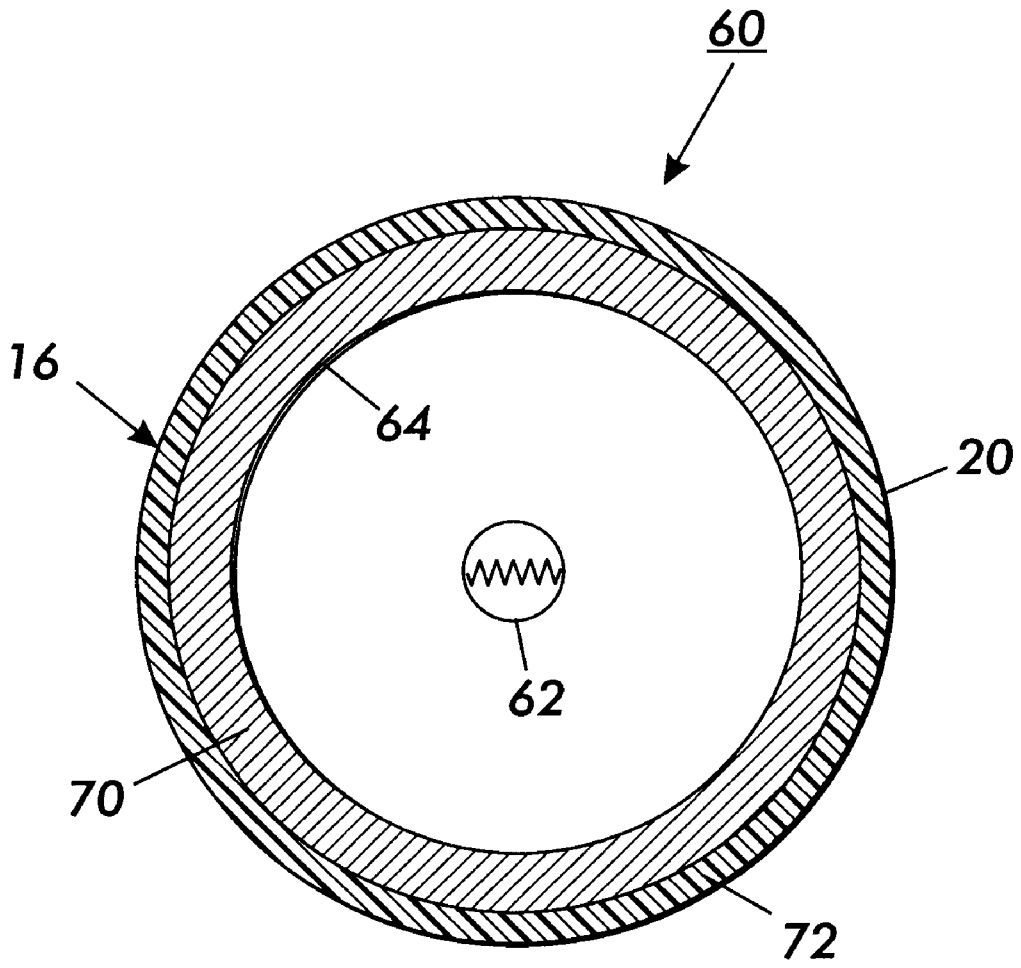
FIG. 2 is a vertical end section of the wear resistant and efficient substrate heating and supporting assembly of FIG. 1.

Referring now to FIGS. 1 and 2, the wear resistant and efficient substrate heating and supporting assembly 60 of the present invention is illustrated. As shown, heating and supporting assembly 60 of the present invention includes a heating device 62 such as a quartz lamp which radiates heat for producing an internal temperature of 130□C. The assembly 60 also includes a sheet or substrate supporting member shown in the form of a drum, such as the drum 16, that comprises a hollow metallic core 70, (made for example of aluminum) and having a wall thickness of about ⅛ of an inch. Equally however, the sheet or substrate supporting member 16 can be a flat platen. In either case the metallic core 70 of the heating and substrate supporting member 16 has a back or inner surface 64 that is located adjacent to, and facing the heating device 62.

Importantly, the metallic core 70 of the heating and substrate supporting member 16 also has an outer ceramic coating or layer 72 including an outer surface 20 thereof for supporting, one at a time, substrates or sheets 19 (FIG. 1) of various sizes. The outer ceramic coating or layer 72 advantageously is made preferably of aluminum nitride sprayed onto the metallic core 70 via a thermal spray process such as High Velocity OxyFuel (HVOF) or plasma spray. The ceramic coating 72 can also be made of aluminum oxide or alumina. The ceramic coating 72 has significant advantages over conventional plastic films such as MYLAR or KAPTON (trademarks of the Du Pont Co.) which are wrapped around a drum, in that the ceramic coating 72 provides increased wear resistance, increased intimate contact with the metal core 70, and better thermal conductivity, than such conventional plastic films. In addition, the HVOF process employed in spraying the ceramic coating 72 offers an advantage over a plasma spray process in that it can more easily attain desired densities, dielectric breakdown strengths, and surface characteristics.

In an application such as this for thermal ink jet print drying and support, a ceramic is chosen because it can reliably produce specific desired properties such as electrical resistance, wear resistance, durability, and high dielectric strength for the heated substrate supporting surface 20. In the thermal ink jet process as described above, the paper 19 may be charged by a biased transfer roll (not shown) in order to create a static charge which will securely attach the paper to the drum 16. Ink from the printheads is applied to the paper, and is dried within one revolution of the drum 16. The drum 16 may then be neutralized by a brush (not shown) at a point where the paper is to be detached from the drum. Stripper fingers (not shown) usually are engaged to "pick" the paper off the drum. In this process as such, the two critical functions of the ceramic coating 72 of the drum 16 are (1) to insulate over the metal core in order to insure that charges created thereon will remain in place sufficiently to hold or attach the paper 19 onto the surface 20, and (2) to enable sufficient transfer of the heat generated by the quartz lamp 62, to reach the surface 20 for heating and drying ink on the paper 19. In addition, the alumina ceramic coating or layer 72 advantageously provides increased wear resistance, is compatible with ink, and provides increased intimate contact with the metal core 70, with little or no risk of coming loose. Furthermore, the alumina ceramic coating 72 enables the drum 16 to have a desired breakdown voltage greater than 1300V.

The HVOF process is used to apply the ceramic, alumina, coating 72 to the metal core 70 because an HVOF coating has good bond strength to metal surfaces, thus ensuring good contact at all points. Ceramics in general have good wear resistance and alumina, a ceramic, has excellent wear properties especially when compared to plastic films. In addition, alumina is an insulative ceramic and for example has good dielectric strength at about 250–400 V/mil when plasma sprayed. The HVOF process provides higher particle velocity and particle impingement than plasma spray and is able to achieve greater densities, thereby resulting in a significantly greater dielectric strength of about 1300–1500 V/mil.

The thickness of the ceramic coating 72 (FIG. 2) depends on the dielectric strength required for a particular application, and such thickness preferably should be minimized in order to achieve maximum thermal conductivity. Because of the excellent dielectric strength of an HVOF alumina coating, the required thickness for ink jet ink drying applications should be about 1–2 mils.

The ceramic coating described herein meets all of the functional requirements for an ink jet substrate heating and supporting member, and because of its wear resistance, it effectively eliminates a potential problem of stripper fingers abrading the surface 20 thereof. Further, it ensures intimate contact with the metal core 70 at all points and thus the thermal conductivity of alumina is substantially is assured.

As can be seen, there has been provided a thermal ink jet printer comprising a frame a printhead mounted to the frame for printing ink images onto a heated and supported substrate, and a substrate heating and supporting assembly mounted to the frame. The heating and supporting assembly includes a heating device, and a substrate supporting member including a body portion having a uniform first surface and a second and opposite surface adjacent the heating device. The uniform first surface includes a ceramic coating formed thereover for contacting and supporting a substrate, and for durably withstanding scraping contact from a stripper finger used for stripping substrates from the outer surface of the ceramic coating.

While the present invention has been described with reference to a preferred embodiment, it will be appreciated from this teaching that within the spirit of the present invention, various alternative modifications, variations or improvements therein may be made by those skilled in the art.

What is claimed is:

1. A thermal ink jet printer comprising:

(a) a frame;

(b) a printhead mounted to said frame for printing ink images onto a heated and supported substrate; and (c) a substrate heating and supporting assembly mounted to said frame, said heating and supporting assembly including:

(i) a heating device; and (ii) a substrate supporting member including a body portion having a uniform first surface and a second and opposite surface adjacent said heating device, said uniform first surface including a ceramic coating formed thereover for contacting and supporting a substrate, and for durably withstanding scraping contact from a stripper member used for stripping substrates from a surface of said ceramic coating.

2. The thermal ink jet printer of claim 1, wherein said substrate supporting member comprises a hollow cylindrical metallic drum having a first, outer surface.

3. The thermal ink jet printer of claim 2, wherein said ceramic coating comprises a coating of aluminum oxide.

4. The thermal ink jet printer of claim 2, wherein said ceramic coating comprises a coating of aluminum nitride.

5. The thermal ink jet printer of claim 2, wherein said hollow cylindrical metallic drum comprises an aluminum drum.

6. The thermal ink jet printer of claim 2, wherein said ceramic coating has a dielectric strength of about 1300–1500 volts per mil.

7. The thermal ink jet printer of claim 2, wherein said ceramic coating has a thickness of 1–2 mils for maximizing heat conduction from said first surface to a substrate being supported on an outer surface of said ceramic coating.

8. The thermal ink jet printer of claim 2, wherein said ceramic coating has a breakdown voltage greater than 1300 volts.

9. The thermal ink jet printer of claim 4, wherein said ceramic coating is an HVOF spray process applied layer for achieving an excellent bond to said first surface of said aluminum drum.

10. The thermal ink jet printer of claim 4, wherein said ceramic coating is a Plasma Spray process applied layer for achieving an excellent bond to said first surface of said aluminum drum.

11. The thermal ink jet printer of claim 4, wherein said ceramic coating is a High Velocity OxyFuel (HVOF) process applied layer for achieving an excellent bond to said first surface of said aluminum drum.

12. The thermal ink jet printer of claim 5, wherein said substrate supporting member includes an electrically insulative layer formed between said first outer surface and said ceramic coating.

* * * * *